US011364474B2

(12) United States Patent
Ishinaga et al.

(10) Patent No.: US 11,364,474 B2
(45) Date of Patent: Jun. 21, 2022

(54) ULTRAFINE BUBBLE GENERATING METHOD AND ULTRAFINE BUBBLE GENERATING APPARATUS

(71) Applicant: CANON KABUSHIKI KAISHA, Tokyo (JP)

(72) Inventors: Hiroyuki Ishinaga, Tokyo (JP); Masahiko Kubota, Tokyo (JP); Akira Yamamoto, Kanagawa (JP); Akitoshi Yamada, Kanagawa (JP); Yoshiyuki Imanaka, Kanagawa (JP); Yumi Yanai, Kanagawa (JP); Teruo Ozaki, Kanagawa (JP); Toshio Kashino, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/158,253

(22) Filed: Jan. 26, 2021

(65) Prior Publication Data

US 2021/0245116 A1 Aug. 12, 2021

(30) Foreign Application Priority Data

Feb. 12, 2020 (JP) ..... JP2020-021502

(51) Int. Cl.

| | |
|---|---|
| ***B01F 23/23*** | (2022.01) |
| ***B01F 23/232*** | (2022.01) |
| ***B01F 35/93*** | (2022.01) |
| ***B01F 23/231*** | (2022.01) |
| *B01B 1/00* | (2006.01) |
| *B01F 23/2373* | (2022.01) |
| *B01F 35/90* | (2022.01) |

(52) U.S. Cl.

CPC ..... *B01F 23/2319* (2022.01); *B01F 23/231* (2022.01); *B01F 23/238* (2022.01); *B01F 23/2323* (2022.01); *B01F 35/93* (2022.01); *B01B 1/00* (2013.01); *B01F 23/2366* (2022.01); *B01F 23/2373* (2022.01); *B01F 2035/99* (2022.01)

(58) Field of Classification Search

CPC ..... B01F 3/04503; B01F 3/04439; B01F 15/066; B01F 23/231; B01F 23/2319; B01F 23/238

See application file for complete search history.

(56) References Cited

U.S. PATENT DOCUMENTS

| | | | | |
|---|---|---|---|---|
| 4,428,757 | A * | 1/1984 | Hall | B01D 51/08 210/188 |
| 8,740,450 | B2 | 6/2014 | Mogami et al. | |
| 10,022,682 | B2 * | 7/2018 | Hata | B01F 3/04503 |
| 2020/0276803 | A1 | 9/2020 | Arimizu et al. | |

FOREIGN PATENT DOCUMENTS

| | | | |
|---|---|---|---|
| JP | 2014-104441 | A | 6/2014 |
| WO | 2009/088085 | A1 | 7/2009 |

* cited by examiner

*Primary Examiner* — Robert A Hopkins
(74) *Attorney, Agent, or Firm* — Venable LLP

(57) ABSTRACT

Provided is an ultrafine bubble generating method and an ultrafine bubble generating apparatus capable of efficiently generating a UFB-containing liquid with high purity. To this end, a flow passage inner volume is varied by using a flow passage inner volume varying element, the liquid is pressurized such that the liquid passes through a narrow portion at high speed and flows into a depressurizing area.

6 Claims, 13 Drawing Sheets

ULTRAFINE BUBBLE GENERATING METHOD AND ULTRAFINE BUBBLE GENERATING APPARATUS

BACKGROUND OF THE INVENTION

Field of the Invention

The present invention relates to an ultrafine bubble generating method and an ultrafine bubble generating apparatus for generating ultrafine bubbles smaller than 1.0 μm in diameter.

Description of the Related Art

Recently, there have been developed techniques for applying the features of fine bubbles such as microbubbles of micrometer-size in diameter and nanobubbles of nanometer-size in diameter. Especially, the utility of ultrafine bubbles (hereinafter also referred to as "UFBs") smaller than 1.0 μm in diameter have been confirmed in various fields.

Japanese Patent Laid-Open No. 2014-104441 discloses a fine air bubble generating apparatus that generates fine bubbles by applying pressure continuously to a liquid in which a gas is pressurized and dissolved and squirting the pressurized liquid from a depressurizing nozzle. International Publication No. WO2009/088085 discloses an apparatus that generates fine bubbles by repeating separating and converging of flows of a gas-mixed liquid with a mixing unit.

The UFB generating apparatuses of Japanese Patent Laid-Open No. 2014-104441 and International Publication No. WO2009/088085 have a problem that both require continuous pressurizing of a liquid at a predetermined pressure to generate the UFBs, and also the sizes of the apparatuses are large to accommodate the complex flow passages, which increases the power consumption.

Additionally, in a case of generating the UFBs of nanometer-size in diameter, the conventional UFB generating apparatuses generate large air bubbles such as the millibubbles of millimeter-size in diameter and the microbubbles of micrometer-size in diameter as by-products, and it requires time to generate the UFBs due to the low generation efficiency. Moreover, a large container is required to take out the UFBs from the various sizes of bubbles, and this makes it difficult to downsize the apparatus.

SUMMARY OF THE INVENTION

The present invention is made in view of solving the above-described problems, and the present invention provides an ultrafine bubble generating method and an ultrafine bubble generating apparatus capable of efficiently generating a UFB-containing liquid with high purity with a simple configuration.

Thus, a method of generating ultrafine bubbles in the present invention is characterized in that the method includes: a liquid supplying step where a liquid is supplied to a flow passage that allows a liquid to flow; a flow passage inner volume varying step where an inner volume of the flow passage to which the liquid is supplied is varied by varying a part of the flow passage; a pressurizing step where, due to the operation of the flow passage inner volume varying step, the liquid that has an amplified flow rate and is pressurized is caused to pass through a narrow portion, which narrows a part of the flow passage such that a flow passage area that is an area of a plane crossing a direction of the flow of the liquid in the flow passage is gradually reduced from upstream to downstream of the flow passage; and a depressurizing step where the liquid that is pressurized in the pressurizing step is depressurized.

According to the present invention, it is possible to provide an ultrafine bubble generating method and an ultrafine bubble generating apparatus capable of efficiently generating a UFB-containing liquid with high purity with a simple configuration.

Further features of the present invention will become apparent from the following description of exemplary embodiments with reference to the attached drawings.

DESCRIPTION OF THE EMBODIMENTS

Figure 1:
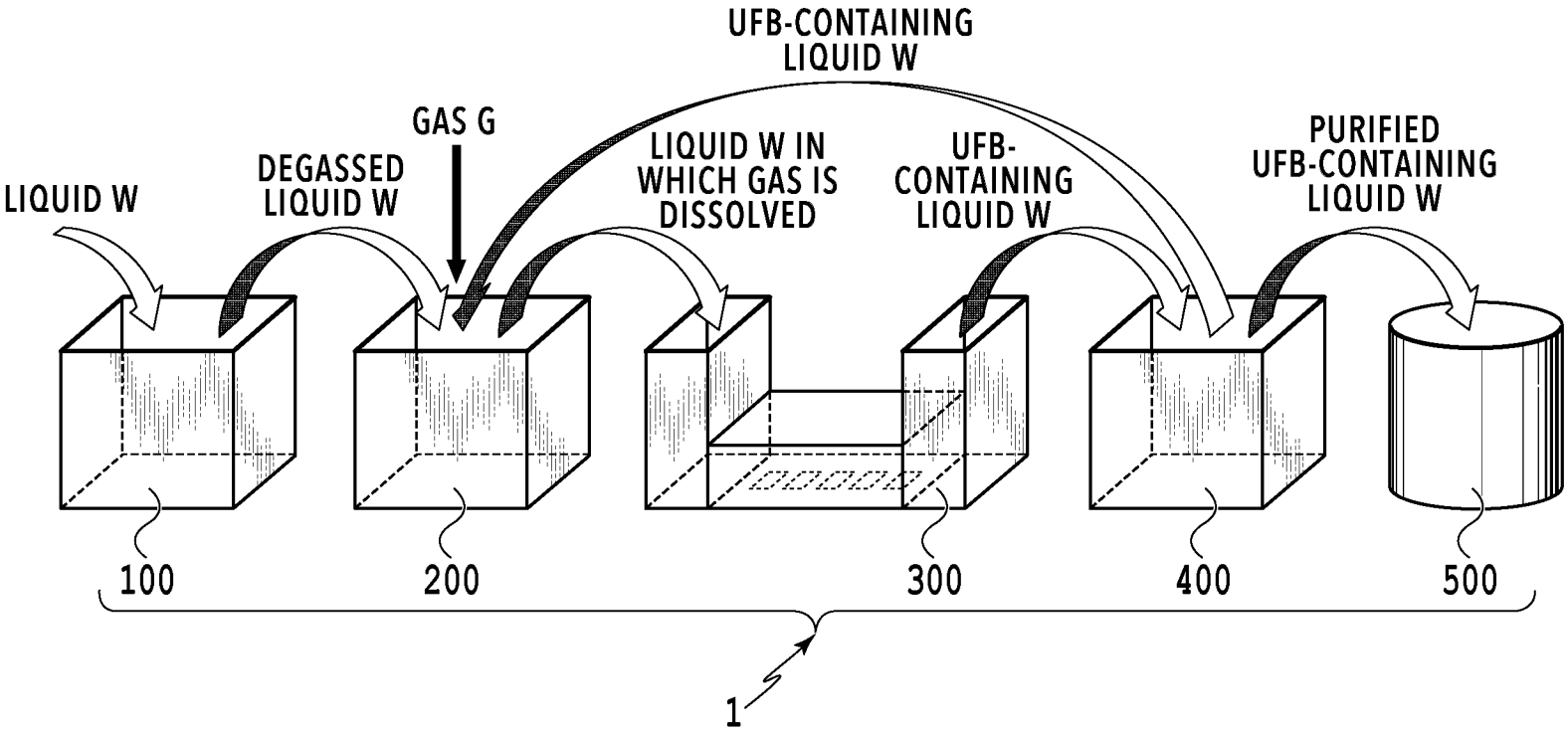
FIG. 1 is a diagram illustrating an example of a UFB generating apparatus.

FIG. 1 is a diagram illustrating an example of a UFB generating apparatus applicable to the present invention. A UFB generating apparatus 1 of this embodiment includes a pre-processing unit 100, dissolving unit 200, a T-UFB generating unit 300, a post-processing unit 400, and a collecting unit 500. Each unit performs unique processing on a liquid W such as tap water supplied to the pre-processing unit 100 in the above order, and the thus-processed liquid W is collected as a T-UFB-containing liquid by the collecting unit 500. Functions and configurations of the units are described below. Although details are described later, UFBs generated by utilizing the film boiling caused by rapid heating are referred to as thermal-ultrafine bubbles (T-UFBs) in this specification.

Figure 2:
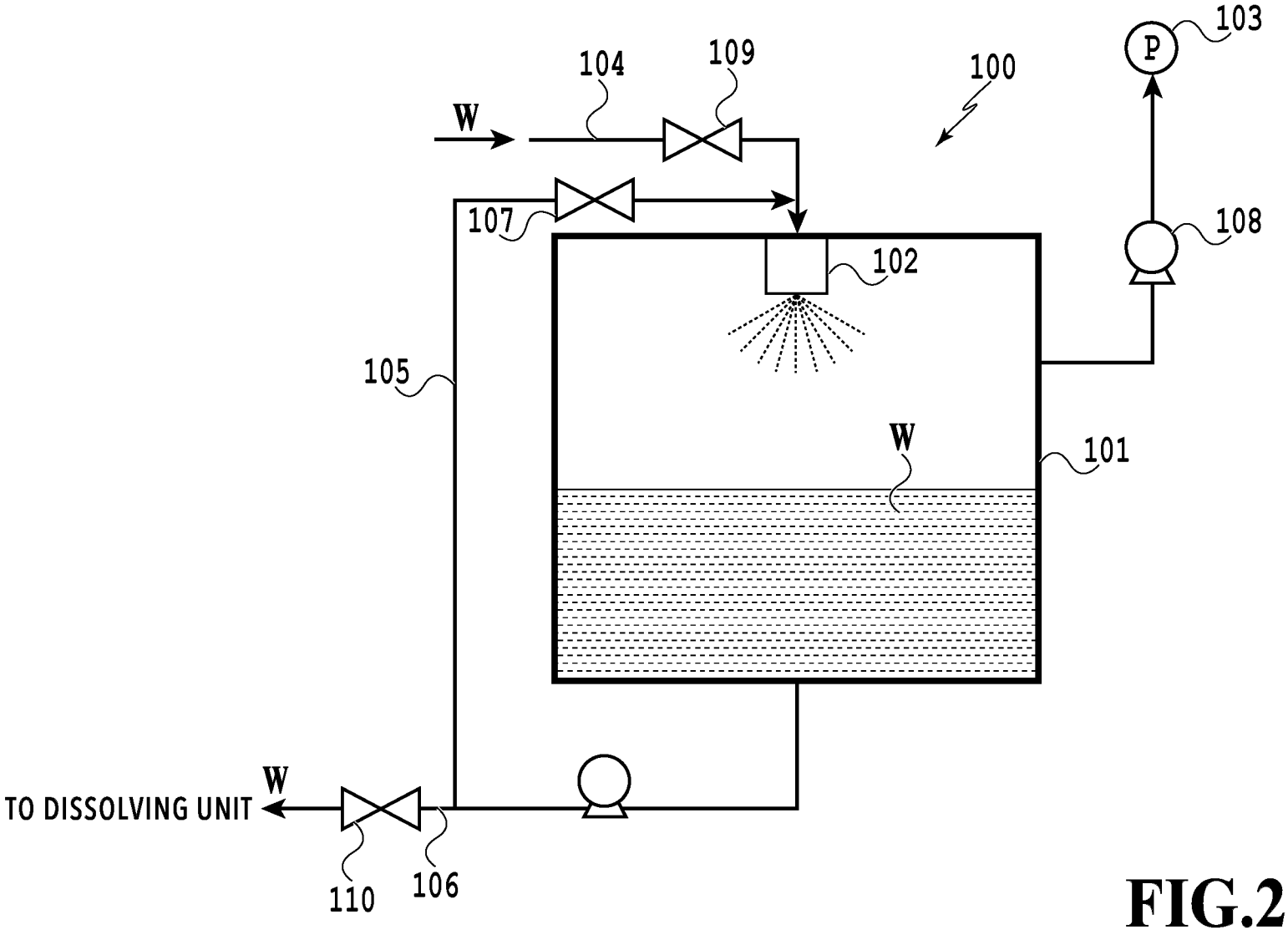
FIG. 2 is a schematic configuration diagram of a preprocessing unit.

FIG. 2 is a schematic configuration diagram of the pre-processing unit 100. The pre-processing unit 100 of this embodiment performs a degassing treatment on the supplied liquid W. The pre-processing unit 100 mainly includes a degassing container 101, a shower head 102, a depressurizing pump 103, a liquid introduction passage 104, a liquid circulation passage 105, and a liquid discharge passage 106. For example, the liquid W such as tap water is supplied to the degassing container 101 from the liquid introduction passage 104 through a valve 109. In this process, the shower head 102 provided in the degassing container 101 sprays a mist of the liquid W in the degassing container 101. The shower head 102 is for prompting the gasification of the liquid W; however, a centrifugal and the like may be used instead as the mechanism for producing the gasification prompt effect.

When a certain amount of the liquid W is reserved in the degassing container 101 and then the depressurizing pump 103 is activated with all the valves closed, already-gasified gas components are discharged, and gasification and discharge of gas components dissolved in the liquid W are also prompted. In this process, the internal pressure of the degassing container 101 may be depressurized to around several hundreds to thousands of Pa (1.0 Torr to 10.0 Torr) while checking a manometer 108. The gases to be removed by the pre-processing unit 100 includes nitrogen, oxygen, argon, carbon dioxide, and so on, for example.

The above-described degassing processing can be repeatedly performed on the same liquid W by utilizing the liquid circulation passage 105. Specifically, the shower head 102 is operated with the valve 109 of the liquid introduction passage 104 and a valve 110 of the liquid discharge passage 106 closed and a valve 107 of the liquid circulation passage 105 opened. This allows the liquid W reserved in the degassing container 101 and degassed once to be resprayed in the degassing container 101 from the shower head 102. In addition, with the depressurizing pump 103 operated, the gasification processing by the shower head 102 and the degassing processing by the depressurizing pump 103 are repeatedly performed on the same liquid W. Every time the above processing utilizing the liquid circulation passage 105 is performed repeatedly, it is possible to decrease the gas components contained in the liquid W in stages. Once the liquid W degassed to a desired purity is obtained, the liquid W is transferred to the dissolving unit 200 through the liquid discharge passage 106 with the valve 110 opened.

FIG. 2 illustrates the degassing unit 100 that depressurizes the gas part to gasify the solute; however, the method of degassing the solution is not limited thereto. For example, a heating and boiling method for boiling the liquid W to gasify the solute may be employed, or a film degassing method for increasing the interface between the liquid and the gas using hollow fibers. A SEPAREL series (produced by DIC corporation) is commercially supplied as the degassing module using the hollow fibers. The SEPAREL series uses poly(4-methylpentene-1) (PMP) for the raw material of the hollow fibers and is used for removing air bubbles from ink and the like mainly supplied for a piezo head. In addition, two or more of an evacuating method, the heating and boiling method, and the film degassing method may be used together.

Figure 3A:
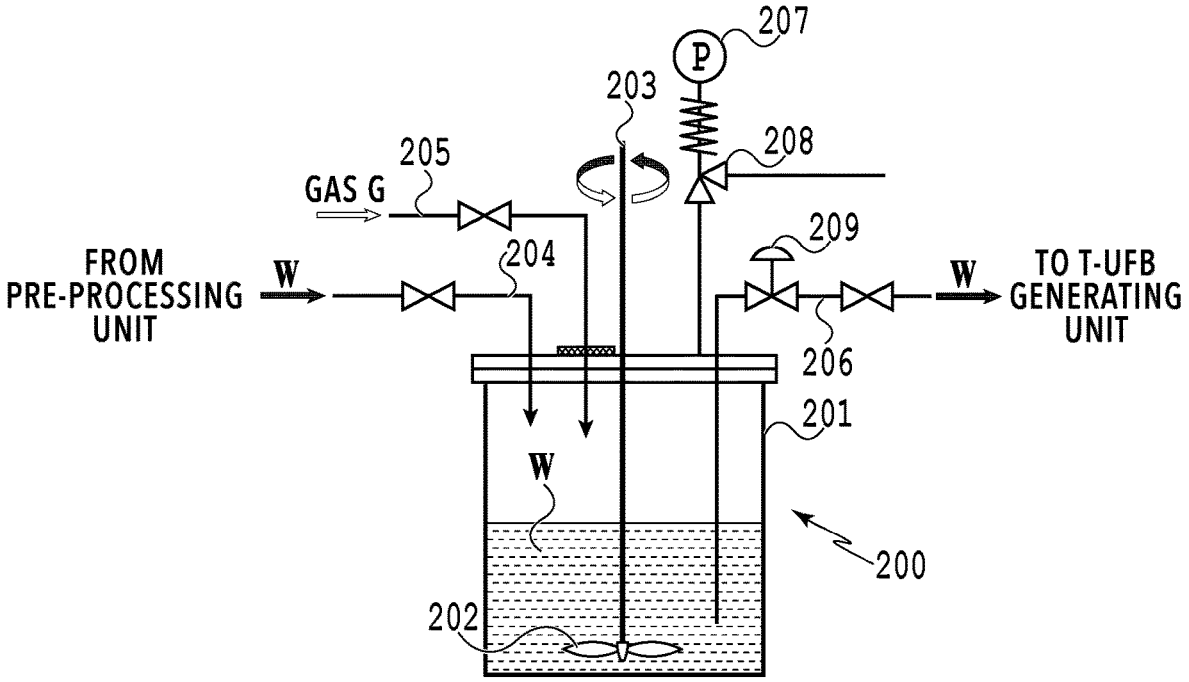
FIG. 3A is a schematic configuration diagram of a dissolving unit and a diagram for describing the dissolving states in a liquid.
Figure 3B:
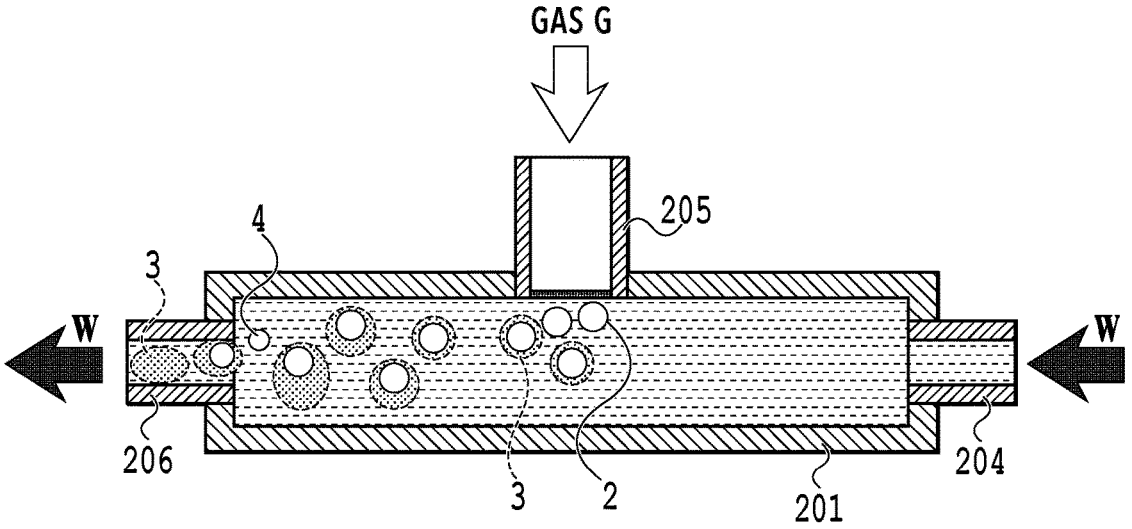
FIG. 3B is another schematic configuration diagram of a dissolving unit and a diagram for describing the dissolving states in a liquid.

FIGS. 3A and 3B are a schematic configuration diagram of the dissolving unit 200 and a diagram for describing the dissolving states in the liquid. The dissolving unit 200 is a unit for dissolving a desired gas into the liquid W supplied from the pre-processing unit 100. The dissolving unit 200 of this embodiment mainly includes a dissolving container 201, a rotation shaft 203 provided with a rotation plate 202, a liquid introduction passage 204, a gas introduction passage 205, a liquid discharge passage 206, and a pressurizing pump 207.

The liquid W supplied from the pre-processing unit 100 is supplied and reserved into the dissolving container 201 through the liquid introduction passage 204. Meanwhile, a gas G is supplied to the dissolving container 201 through the gas introduction passage 205.

Once predetermined amounts of the liquid W and the gas G are reserved in the dissolving container 201, the pressurizing pump 207 is activated to increase the internal pressure of the dissolving container 201 to about 0.5 MPa. A safety valve 208 is arranged between the pressurizing pump 207 and the dissolving container 201. With the rotation plate 202 in the liquid rotated via the rotation shaft 203, the gas G supplied to the dissolving container 201 is transformed into air bubbles, and the contact area between the gas G and the liquid W is increased to prompt the dissolution into the liquid W. This operation is continued until the solubility of the gas G reaches almost the maximum saturation solubility. In this case, a unit for decreasing the temperature of the liquid may be provided to dissolve the gas as much as possible. When the gas is with low solubility, it is also possible to increase the internal pressure of the dissolving container 201 to 0.5 MPa or higher. In this case, the material and the like of the container need to be the optimum for safety sake.

Once the liquid W in which the components of the gas G are dissolved at a desired concentration is obtained, the liquid W is discharged through the liquid discharge passage 206 and supplied to the UFB generating unit 300. In this process, a back-pressure valve 209 adjusts the flow pressure of the liquid W to prevent excessive increase of the pressure during the supplying.

FIG. 3B is a diagram schematically illustrating the dissolving states of the gas G put in the dissolving container 201. An air bubble 2 containing the components of the gas G put in the liquid W is dissolved from a portion in contact with the liquid W. The air bubble 2 thus shrinks gradually, and a gas-dissolved liquid 3 then appears around the air bubble 2. Since the air bubble 2 is affected by the buoyancy, the air bubble 2 may be moved to a position away from the center of the gas-dissolved liquid 3 or be separated out from the gas-dissolved liquid 3 to become a residual air bubble 4. Specifically, in the liquid W to be supplied to the UFB generating unit 300 through the liquid discharge passage 206, there is a mix of the air bubbles 2 surrounded by the gas-dissolved liquids 3 and the air bubbles 2 and the gas-dissolved liquids 3 separated from each other.

The gas-dissolved liquid 3 in the drawings means "a region of the liquid W in which the dissolution concentration of the gas G mixed therein is relatively high." In the gas components actually dissolved in the liquid W, the concentration of the gas components in the gas-dissolved liquid 3 is the highest at a portion surrounding the air bubble 2. In a case where the gas-dissolved liquid 3 is separated from the air bubble 2 the concentration of the gas components of the gas-dissolved liquid 3 is the highest at the center of the region, and the concentration is continuously decreased as away from the center. That is, although the region of the gas-dissolved liquid 3 is surrounded by a broken line in FIG. 3B for the sake of explanation, such a clear boundary does not actually exist. In addition, in the present invention, a gas that cannot be dissolved completely may be accepted to exist in the form of an air bubble in the liquid.

Figure 4:
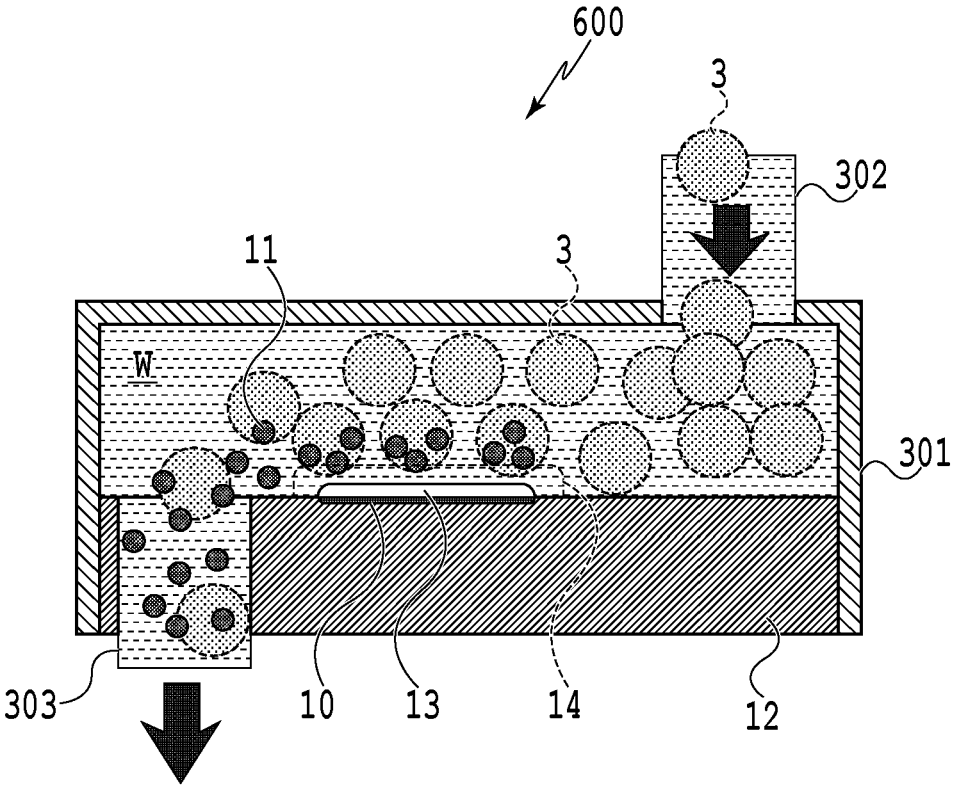
FIG. 4 is a schematic configuration diagram of a UFB generating unit.

FIG. 4 is a schematic diagram showing a part of the UFB generating unit 300 as an example, and is a schematic configuration diagram showing a UFB generation unit 600 that generates UFB by utilizing film boiling accompanying rapid heat generation. In the present specification, the UFB generated by utilizing the film boiling accompanying the rapid heat generation is referred to as T-UFB (Thermal-Ultra Fine Bubble).

The UFB generation unit 600 mainly includes a chamber 301, a liquid introduction path 302, and a liquid discharge passage 303, and a flow from the liquid introduction passage 302 through the chamber 301 to the liquid discharge passage 303 is formed by a not-illustrated flow pump. As the flow pump, various pumps including a diaphragm pump, a gear pump, and a screw pump may be employed as the flow pump. The gas-dissolved liquid 3 of the gas G put by the dissolving unit 200 is mixed in the liquid W introduced from the liquid introduction passage 302.

An element substrate 12 provided with a heating element 10 is arranged on a bottom section of the chamber 301. With a predetermined voltage pulse applied to the heating element 10, a bubble 13 generated by the film boiling (hereinafter, also referred to as a film boiling bubble 13) is generated in a region in contact with the heating element 10. Then, an ultrafine bubble (T-UFB) 11 containing the gas G is generated caused by expansion and shrinkage of the film boiling bubble 13. As a result, a UFB-containing liquid W containing many T-UFBs 11 is discharged from the liquid discharge passage 303.

Figure 5A:
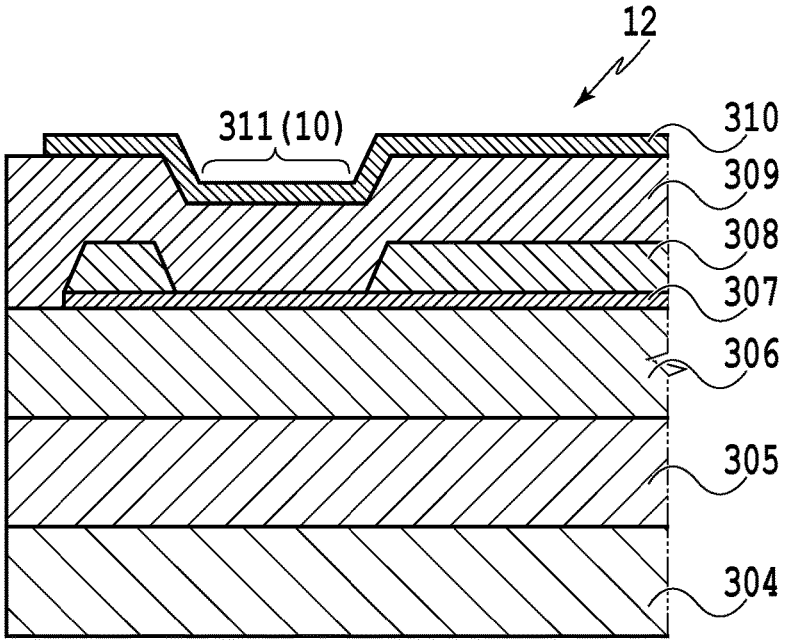
FIG. 5A is a diagram for describing details of a heating element.
Figure 5B:
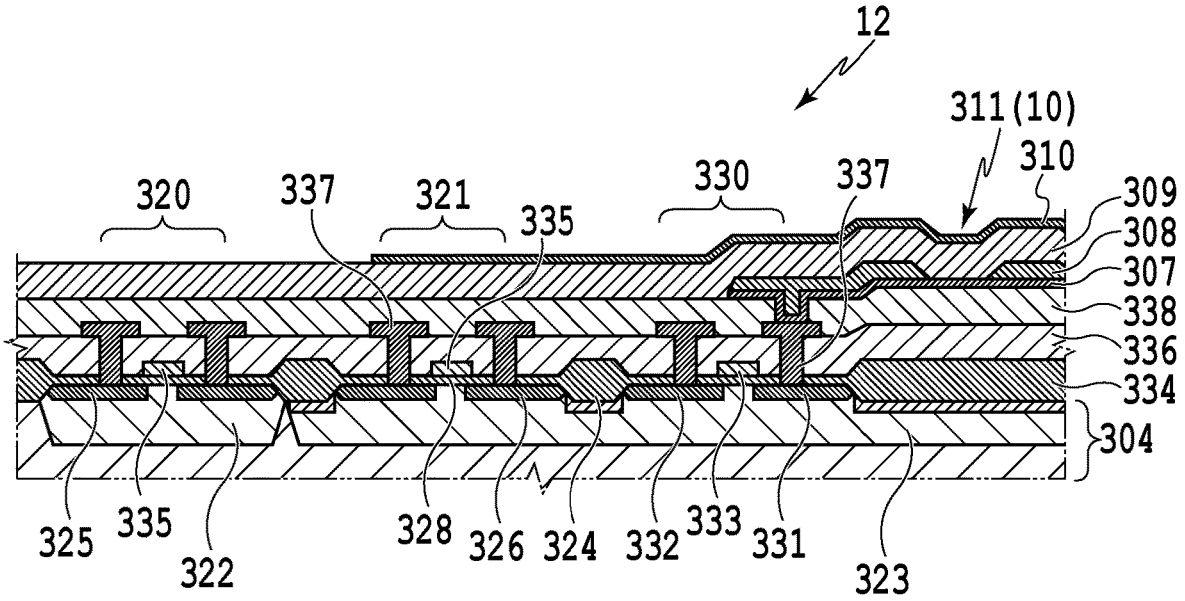
FIG. 5B is another diagram for describing details of a heating element.

FIGS. 5A and 5B are diagrams for illustrating a detailed configuration of the heating element 10. FIG. 5A illustrates a closeup view of the heating element 10, and FIG. 5B illustrates a cross-sectional view of a wider region of the element substrate 12 including the heating element 10.

As illustrated in FIG. 5A, in the element substrate 12 of this embodiment, a thermal oxide film 305 as a heat-accumulating layer and an interlaminar film 306 also served as a heat-accumulating layer are laminated on a surface of a silicon substrate 304. An SiO2 film or an SiN film may be used as the interlaminar film 306. A resistive layer 307 is formed on a surface of the interlaminar film 306, and a wiring 308 is partially formed on a surface of the resistive layer 307. An Al-alloy wiring of Al, Al—Si, Al—Cu, or the like may be used as the wiring 308. A protective layer 309 made of an SiO2 film or an Si3N4 film is formed on surfaces of the wiring 308, the resistive layer 307, and the interlaminar film 306.

A cavitation-resistant film 310 for protecting the protective layer 309 from chemical and physical impacts due to the heat evolved by the resistive layer 307 is formed on a portion and around the portion on the surface of the protective layer 309, the portion corresponding to a heat-acting portion 311 that eventually becomes the heating element 10. A region on the surface of the resistive layer 307 in which the wiring 308 is not formed is the heat-acting portion 311 in which the resistive layer 307 evolves heat. The heating portion of the resistive layer 307 on which the wiring 308 is not formed functions as the heating element (heater) 10. As described above, the layers in the element substrate 12 are sequentially formed on the surface of the silicon substrate 304 by a semiconductor production technique, and the heat-acting portion 311 is thus provided on the silicon substrate 304.

The configuration illustrated in the drawings is an example, and various other configurations are applicable. For example, a configuration in which the laminating order of the resistive layer 307 and the wiring 308 is opposite, and a configuration in which an electrode is connected to a lower surface of the resistive layer 307 (so-called a plug electrode configuration) are applicable. In other words, as described later, any configuration may be applied as long as the configuration allows the heat-acting portion 311 to heat the liquid for generating the film boiling in the liquid.

FIG. 5B is an example of a cross-sectional view of a region including a circuit connected to the wiring 308 in the element substrate 12. An N-type well region 322 and a P-type well region 323 are partially provided in a top layer of the silicon substrate 304, which is a P-type conductor. AP-MOS 320 is formed in the N-type well region 322 and an N-MOS 321 is formed in the P-type well region 323 by introduction and diffusion of impurities by the ion implantation and the like in the general MOS process.

The P-MOS 320 includes a source region 325 and a drain region 326 formed by partial introduction of N-type or P-type impurities in a top layer of the N-type well region 322, a gate wiring 335, and so on. The gate wiring 335 is deposited on a part of a top surface of the N-type well region 322 excluding the source region 325 and the drain region 326, with a gate insulation film 328 of several hundreds of Å in thickness interposed between the gate wiring 335 and the top surface of the N-type well region 322.

The N-MOS 321 includes the source region 325 and the drain region 326 formed by partial introduction of N-type or P-type impurities in a top layer of the P-type well region 323, the gate wiring 335, and so on. The gate wiring 335 is deposited on a part of a top surface of the P-type well region 323 excluding the source region 325 and the drain region 326, with the gate insulation film 328 of several hundreds of Å in thickness interposed between the gate wiring 335 and the top surface of the P-type well region 323. The gate wiring 335 is made of polysilicon of 3000 Å to 5000 Å in thickness deposited by the CVD method. A C-MOS logic is constructed with the P-MOS 320 and the N-MOS 321.

In the P-type well region 323, an N-MOS transistor 330 for driving an electrothermal conversion element (heating resistance element) is formed on a portion different from the portion including the N-MOS 321. The N-MOS transistor 330 includes a source region 332 and a drain region 331 partially provided in the top layer of the P-type well region 323 by the steps of introduction and diffusion of impurities, a gate wiring 333, and so on. The gate wiring 333 is deposited on a part of the top surface of the P-type well region 323 excluding the source region 332 and the drain region 331, with the gate insulation film 328 interposed between the gate wiring 333 and the top surface of the P-type well region 323.

In this example, the N-MOS transistor 330 is used as the transistor for driving the electrothermal conversion element. However, the transistor for driving is not limited to the N-MOS transistor 330, and any transistor may be used as long as the transistor has a capability of driving multiple electrothermal conversion elements individually and can implement the above-described fine configuration. Although the electrothermal conversion element and the transistor for driving the electrothermal conversion element are formed on the same substrate in this example, those may be formed on different substrates separately.

An oxide film separation region 324 is formed by field oxidation of 5000 Å to 10000 Å in thickness between the elements, such as between the P-MOS 320 and the N-MOS 321 and between the N-MOS 321 and the N-MOS transistor 330. The oxide film separation region 324 separates the elements. A portion of the oxide film separation region 324 corresponding to the heat-acting portion 311 functions as a heat-accumulating layer 334, which is the first layer on the silicon substrate 304.

An interlayer insulation film 336 including a PSG film, a BPSG film, or the like of about 7000 Å in thickness is formed by the CVD method on each surface of the elements such as the P-MOS 320, the N-MOS 321, and the N-MOS transistor 330. After the interlayer insulation film 336 is made flat by heat treatment, an Al electrode 337 as a first wiring layer is formed in a contact hole penetrating through the interlayer insulation film 336 and the gate insulation film 328. On surfaces of the interlayer insulation film 336 and the Al electrode 337, an interlayer insulation film 338 including an SiO2 film of 10000 Å to 15000 Å in thickness is formed by a plasma CVD method. On the surface of the interlayer insulation film 338, a resistive layer 307 including a TaSiN film of about 500 Å in thickness is formed by a co-sputter method on portions corresponding to the heat-acting portion 311 and the N-MOS transistor 330. The resistive layer 307 is electrically connected with the Al electrode 337 near the drain region 331 via a through-hole formed in the interlayer insulation film 338. On the surface of the resistive layer 307, the wiring 308 of Al as a second wiring layer for a wiring to each electrothermal conversion element is formed. The protective layer 309 on the surfaces of the wiring 308, the resistive layer 307, and the interlayer insulation film 338 includes an SiN film of 3000 Å in thickness formed by the plasma CVD method. The cavitation-resistant film 310 deposited on the surface of the protective layer 309 includes a thin film of about 2000 Å in thickness, which is at least one metal selected from the group consisting of Ta, Fe, Ni, Cr, Ge, Ru, Zr, Ir, and the like. Various materials other than the above-described TaSiN such as TaN, CrSiN, TaAl, WSiN, and the like can be applied as long as the material can generate the film boiling in the liquid.

Figure 6A:
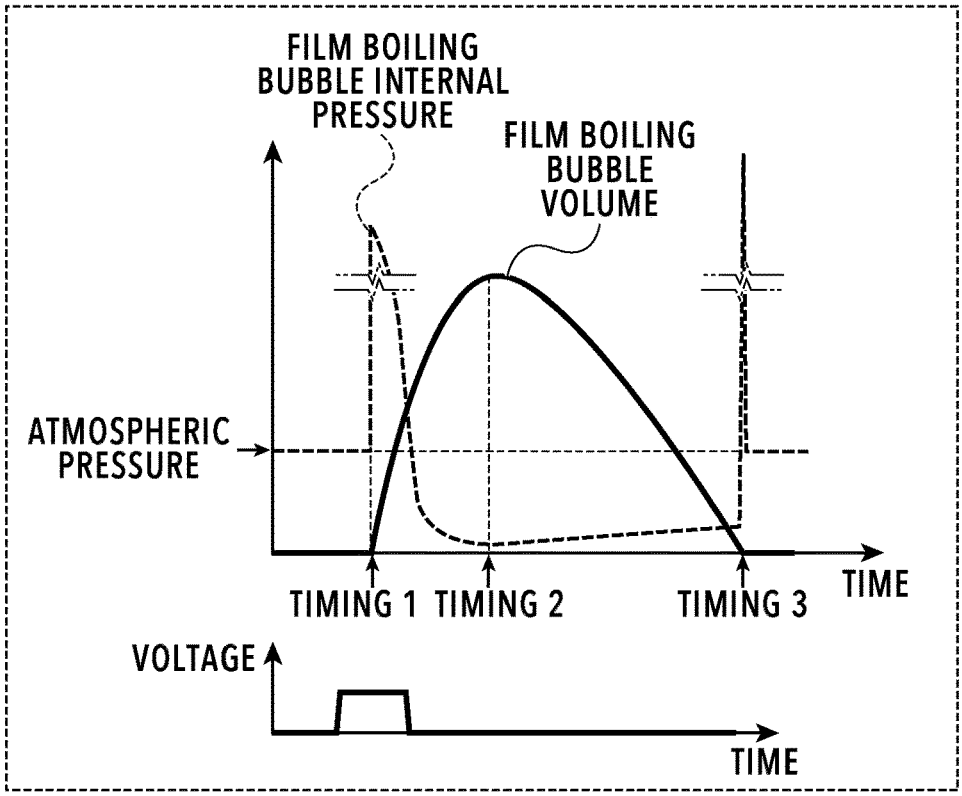
FIG. 6A is a diagram illustrating the states of film boiling in a case where a predetermined voltage pulse is applied to the heating element.
Figure 6B:
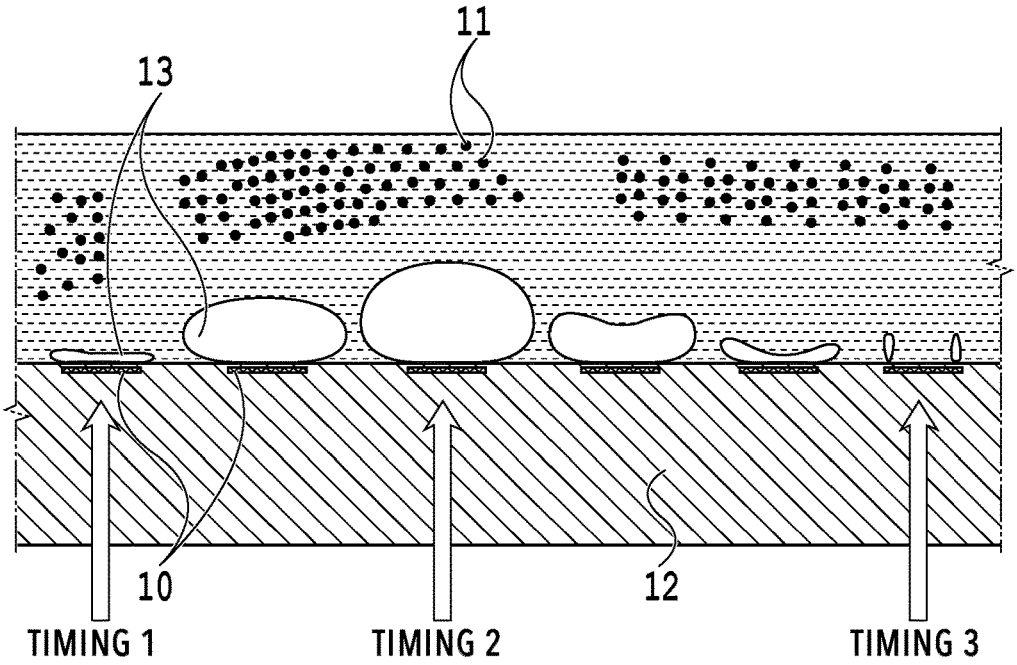
FIG. 6B is another diagram illustrating the states of film boiling in a case where a predetermined voltage pulse is applied to the heating element.

FIGS. 6A and 6B are diagrams illustrating the states of the film boiling when a predetermined voltage pulse is applied to the heating element 10. In this case, the case of generating the film boiling under atmospheric pressure is described. In FIG. 6A, the horizontal axis represents time. The vertical axis in the lower graph represents a voltage applied to the heating element 10, and the vertical axis in the upper graph represents the volume and the internal pressure of the film boiling bubble 13 generated by the film boiling. On the other hand, FIG. 6B illustrates the states of the film boiling bubble 13 in association with timings 1 to 3 shown in FIG. 6A. Each of the states is described below in chronological order. The UFBs 11 generated by the film boiling as described later are mainly generated near a surface of the film boiling bubble 13. The states illustrated in FIG. 6B are the states where the UFBs 11 generated by the generating unit 300 are resupplied to the dissolving unit 200 through the circulation route, and the liquid containing the UFBs 11 is resupplied to the liquid passage of the generating unit 300, as illustrated in FIG. 1.

Before a voltage is applied to the heating element 10, the atmospheric pressure is substantially maintained in the chamber 301. Once a voltage is applied to the heating element 10, the film boiling is generated in the liquid in contact with the heating element 10, and a thus-generated air bubble (hereinafter, referred to as the film boiling bubble 13) is expanded by a high pressure acting from inside (timing 1). A bubbling pressure in this process is expected to be around 8 to 10 MPa, which is a value close to a saturation vapor pressure of water.

The time for applying a voltage (pulse width) is around 0.5 μsec to 10.0 μsec, and the film boiling bubble 13 is expanded by the inertia of the pressure obtained in timing 1 even after the voltage application. However, a negative pressure generated with the expansion is gradually increased inside the film boiling bubble 13, and the negative pressure acts in a direction to shrink the film boiling bubble 13. After a while, the volume of the film boiling bubble 13 becomes the maximum in timing 2 when the inertial force and the negative pressure are balanced, and thereafter the film boiling bubble 13 shrinks rapidly by the negative pressure.

In the disappearance of the film boiling bubble 13, the film boiling bubble 13 disappears not in the entire surface of the heating element 10 but in one or more extremely small regions. For this reason, on the heating element 10, further greater force than that in the bubbling in timing 1 is generated in the extremely small region in which the film boiling bubble 13 disappears (timing 3).

The generation, expansion, shrinkage, and disappearance of the film boiling bubble 13 as described above are repeated every time a voltage pulse is applied to the heating element 10, and new T-UFBs 11 are generated each time.

Figure 7A:
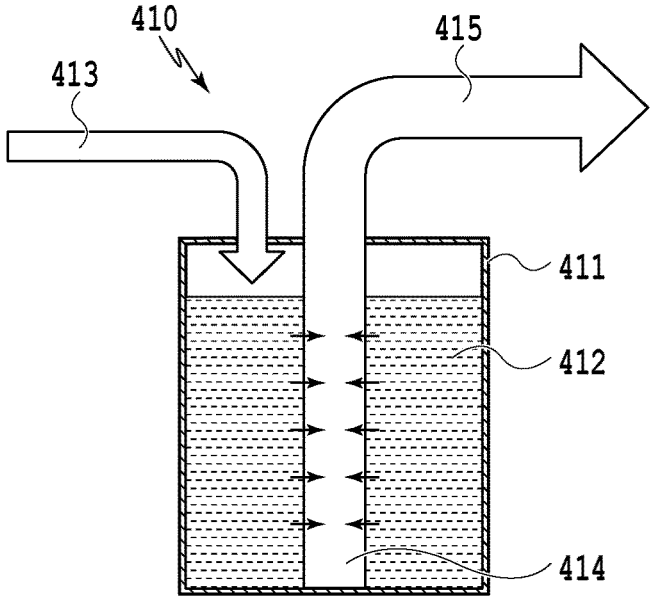
FIG. 7A is a diagram illustrating configuration examples of a post-processing unit.
Figure 7B:
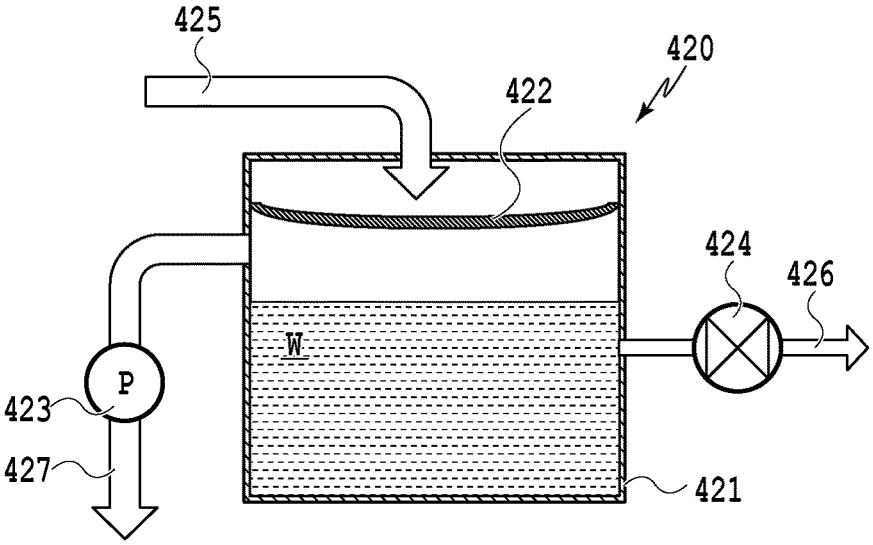
FIG. 7B is another diagram illustrating configuration examples of a post-processing unit.
Figure 7C:
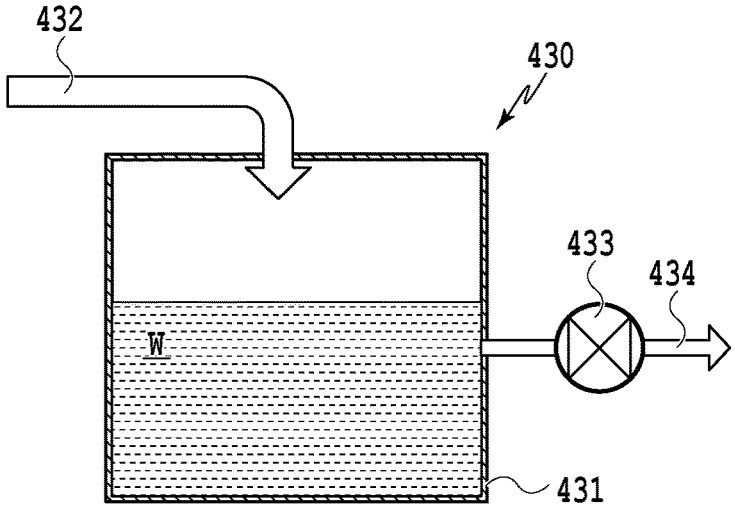
FIG. 7C is yet another diagram illustrating configuration examples of a post-processing unit.

FIGS. 7A to 7C are diagrams illustrating configuration examples of the post-processing unit 400, and FIG. 7A is a diagram illustrating a first post-processing mechanism 410 that removes the inorganic ions. The first post-processing mechanism 410 includes an exchange container 411, cation exchange resins 412, a liquid introduction passage 413, a collecting pipe 414, and a liquid discharge passage 415. The exchange container 411 stores the cation exchange resins 412. The UFB-containing liquid W generated by the UFB generating unit 300 is injected to the exchange container 411 through the liquid introduction passage 413 and absorbed into the cation exchange resins 412 such that the cations as the impurities are removed. Such impurities include metal materials peeled off from the element substrate 12 of the UFB generating unit 300, such as $SiO_2$, SiN, SiC, Ta, $Al_2O_3$, $Ta_2O_5$, and Ir.

The cation exchange resins 412 are synthetic resins in which a functional group (ion exchange group) is introduced in a high polymer matrix having a three-dimensional network, and the appearance of the synthetic resins is spherical particles of around 0.4 to 0.7 mm. A general high polymer matrix is the styrene-divinylbenzene copolymer, and the functional group may be that of methacrylic acid series and acrylic acid series, for example. Note that, the above materials are examples. As long as desired inorganic ions can be removed effectively, the above materials can be changed to various materials. The UFB-containing liquid W absorbed in the cation exchange resins 412 to remove the inorganic ions is collected by the collecting pipe 414 and transferred to the next step through the liquid discharge passage 415.

FIG. 7B illustrates a second post-processing mechanism 420 that removes the organic substances. The second post-processing mechanism 420 includes a storage container 421, a filtration filter 422, a vacuum pump 423, a valve 424, a liquid introduction passage 425, a liquid discharge passage 426, and an air suction passage 427. Inside of the storage container 421 is divided into upper and lower two regions by the filtration filter 422. The liquid introduction passage 425 is connected to the upper region of the upper and lower two regions, and the air suction passage 427 and the liquid discharge passage 426 are connected to the lower region thereof. Once the vacuum pump 423 is driven with the valve 424 closed, the air in the storage container 421 is ejected through the air suction passage 427 to make the pressure inside the storage container 421 negative pressure, and the UFB-containing liquid W is introduced from the liquid introduction passage 425. Then, the UFB-containing liquid W from which the impurities are removed by the filtration filter 422 is reserved into the storage container 421.

The impurities removed by the filtration filter 422 include organic materials that may be mixed at a tube or each unit, such as organic compounds including silicon, siloxane, and epoxy, for example. A filter film usable for the filtration filter 422 includes a filter of a sub-μm-mesh that can remove bacteria, and a filter of a nm-mesh that can remove virus.

After a certain amount of the UFB-containing liquid W is reserved in the storage container 421, the vacuum pump 423 is stopped and the valve 424 is opened to transfer the UFB-containing liquid in the storage container 421 to the next step through the liquid discharge passage 426. Although the vacuum filtration method is employed as the method of removing the organic impurities herein, a gravity filtration method and a pressurized filtration can also be employed as the filtration method using a filter, for example.

FIG. 7C illustrates a third post-processing mechanism 430 that removes the insoluble solid substances. The third post-processing mechanism 430 includes a precipitation container 431, a liquid introduction passage 432, a valve 433, and a liquid discharge passage 434.

First, a predetermined amount of the UFB-containing liquid W is reserved into the precipitation container 431 through the liquid introduction passage 432 with the valve 433 closed, and leaving it for a while. Meanwhile, the solid substances in the UFB-containing liquid W are precipitated onto the bottom of the precipitation container 431 by gravity. Among the bubbles in the UFB-containing liquid, relatively large bubbles such as microbubbles are raised to the liquid surface by the buoyancy and also removed from the UFB-containing liquid. After a lapse of sufficient time, the valve 433 is opened, and the UFB-containing liquid W from which the solid substances and large bubbles are removed is transferred to the collecting unit 500 through the liquid discharge passage 434. The example of applying the three post-processing mechanisms in sequence is shown in this embodiment; however, the configuration is not limited thereto, and a needed post-processing mechanism may be employed if necessary.

Reference to FIG. 1 is made again. The UFB-containing liquid W from which the impurities are removed by the post-processing unit 400 may be directly transferred to the collecting unit 500 or may be put back to the dissolving unit 200 again. In the latter case, the gas dissolution concentration of the UFB-containing liquid W that is decreased due to the generation of the UFBs can be compensated to the saturated state again by the dissolving unit 200. If new UFBs are generated by the UFB generating unit 300 after the compensation, it is possible to further increase the concentration of the UFBs contained in the UFB-containing liquid with the above-described properties. That is, it is possible to increase the concentration of the contained UFBs by the number of circulations through the dissolving unit 200, the UFB generating unit 300, and the post-processing unit 400, and it is possible to transfer the UFB-containing liquid W to the collecting unit 500 after a desired concentration of the contained UFBs is obtained.

The collecting unit 500 collects and preserves the UFB-containing liquid W transferred from the post-processing unit 400. The UFB-containing liquid collected by the collecting unit 500 is a UFB-containing liquid with high purity from which various impurities are removed.

In the collecting unit 500, the UFB-containing liquid W may be classified by the sizes of the UFBs by performing some stages of filtration processing. Since it is expected that the temperature of the UFB-containing liquid W obtained by the UFB method is higher than the normal temperature, the collecting unit 500 may be provided with a cooling unit. The cooling unit may be provided in a part of the post-processing unit 400.

The overview of the UFB generating apparatus 1 is given above; however, it is needless to say that the illustrated multiple units can be changed, and not all of them need to be prepared. Depending on the types of the liquid W and the gas G to be used and the intended use of the UFB-containing liquid to be generated, some of the above-described units may be omitted, or another unit other than the above-described units may be added.

For example, in a case where the gas to be contained in the UFBs is the atmospheric air, the pre-processing unit 100 and the dissolving unit 200 can be omitted. On the other hand, in a case where multiple types of gases are desired to be contained in the UFBs, an additional dissolving unit 200 may be added.

The units for removing the impurities as described in FIGS. 7A to 7C may be provided upstream of the UFB generating unit 300 or may be provided both upstream and downstream thereof. In a case where the liquid to be supplied to the UFB generating apparatus is tap water, rain water, contaminated water, or the like, there may be contained organic and inorganic impurities in the liquid. If such a liquid W containing the impurities is supplied to the UFB generating unit 300, there is a risk of deteriorating the heating element 10 and inducing the salting-out phenomenon. With the mechanisms as illustrated in FIGS. 7A to 7C provided upstream of the UFB generating unit 300, it is possible to remove the above-described impurities previously.

Figure 8:
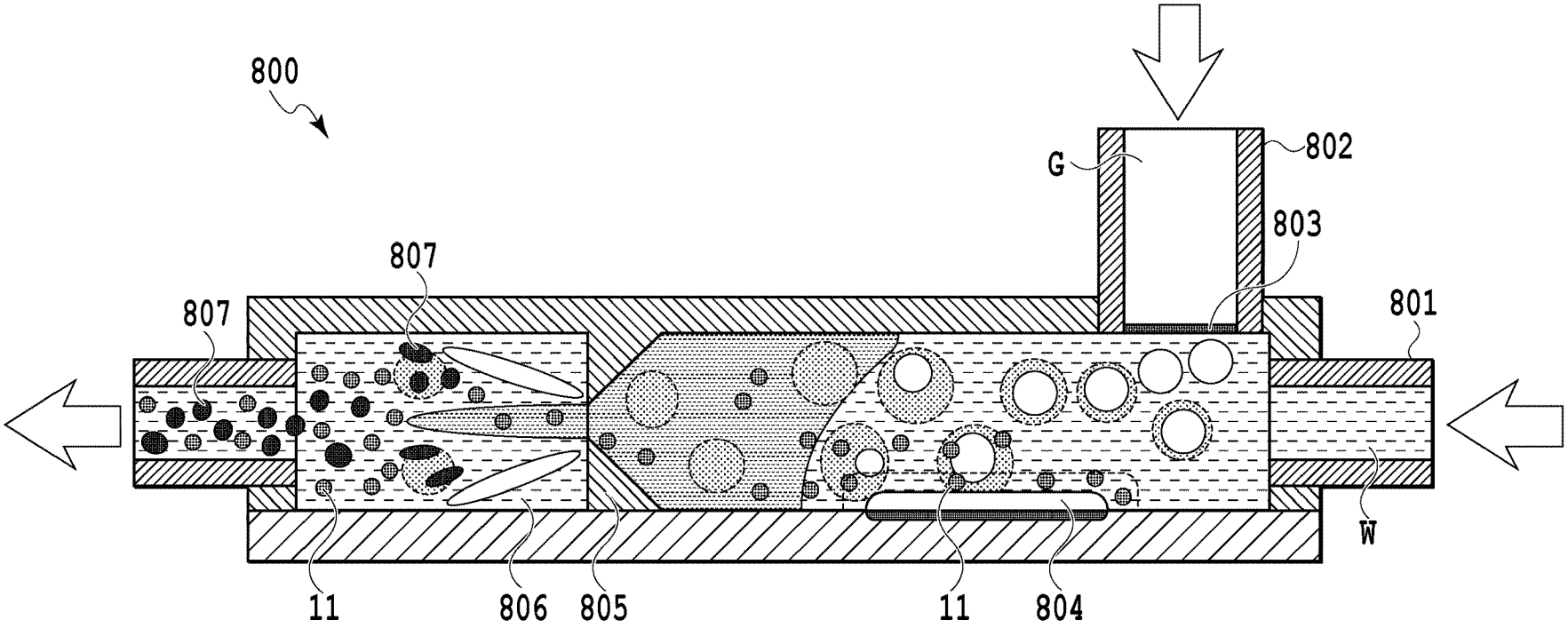
FIG. 8 is a schematic diagram illustrating a UFB generating device.

FIG. 8 is a schematic diagram illustrating a UFB generating device 800 in this embodiment. The UFB generating device 800 has both the functions of the above-described dissolving unit 200 and UFB generating unit 300. That is, the UFB generating device 800 is supplied with the degassed liquid W and the gas G, generates the UFBs inside thereof, and ejects a UFB-containing liquid containing the UFBs.

The UFB generating device 800 generates T-UFBs through the film boiling generated with the gas G being dissolved in the liquid W and the liquid W in which the gas G is dissolved being heated. Additionally, while generating the T-UFBs, the UFB generating device 800 uses the growth of the bubbles generated by the film boiling to move the liquid, further increases the flow rate of the moving liquid by a liquid flow rate amplifying element 805, and generates UFBs 807 by rapid depressurizing by the Venturi effect in a depressurizing area (depressurizing chamber) 806. Thus, the UFBs 807 that are generated by the further increase in the flow rate by the liquid flow rate amplifying element 805 and the rapid depressurizing by the Venturi effect in the depressurizing area 806 are referred to as Venturi-ultrafine bubbles (V-UFBs) herein.

FIGS. 9A to 9G are diagrams illustrating operation steps of generating a liquid W containing the T-UFBs 11 and the V-UFBs 807 by the UFB generating device 800 in sequence. Hereinafter, the operation steps are described in the order of the operations.

Figures 9A, 9B, 9C, 9D, 9E, 9F, 9G:
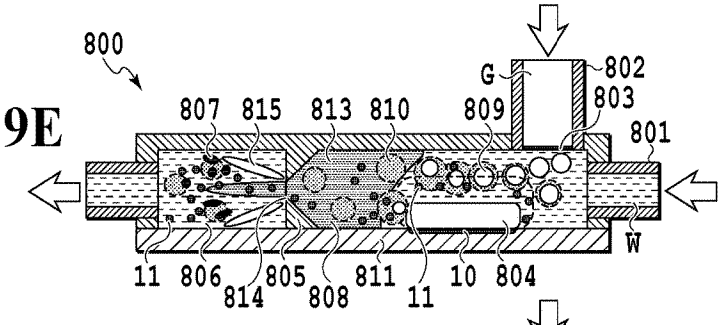
FIG. 9A is a diagram illustrating operation steps of generating a liquid containing T-UFBs and V-UFBs in sequence.
FIG. 9B is another diagram illustrating operation steps of generating a liquid containing T-UFBs and V-UFBs in sequence.
FIG. 9C is yet another diagram illustrating operation steps of generating a liquid containing T-UFBs and V-UFBs in sequence.
FIG. 9D is yet another diagram illustrating operation steps of generating a liquid containing T-UFBs and V-UFBs in sequence.
FIG. 9E is yet another diagram illustrating operation steps of generating a liquid containing T-UFBs and V-UFBs in sequence.
FIG. 9F is yet another diagram illustrating operation steps of generating a liquid containing T-UFBs and V-UFBs in sequence.
FIG. 9G is yet another diagram illustrating operation steps of generating a liquid containing T-UFBs and V-UFBs in sequence.

FIG. 9A is a diagram illustrating a step where the liquid W is supplied into a UFB generating liquid flow passage 808 from a liquid supply passage 801. The UFB generating device 800 includes the liquid supply passage 801 through which the liquid W is supplied, a gas supply passage 802 through which the gas G is supplied, and the UFB generating liquid flow passage 808 as a flow passage through which the UFBs are generated. The liquid supply passage 801 supplies the liquid W, and the gas supply passage 802 supplies the gas G. A connected portion between the gas supply passage 802 and the UFB generating liquid flow passage 808 is provided with a gas-liquid separation film 803 that allows a gas but not a liquid to pass therethrough, and the gas G and the liquid W are separated from each other by the gas-liquid separation film 803.

FIG. 9B is a diagram illustrating a step where the gas G is supplied into the UFB generating liquid flow passage 808 through the gas-liquid separation film 803. Since the gas G is supplied into the UFB generating liquid flow passage 808 through the gas-liquid separation film 803 while maintaining the form of the gas G, the gas G exists as gas bubbles 809 in the liquid W. The gas bubbles 809 are then dissolved in the liquid W from a surface of the liquid W, and become gas-dissolved water 810. Some of them are mixtures of the gas bubbles 809 and the gas-dissolved water 810 that are transitional. The gas-dissolved water 810 is moved with a flow of the supplying of the liquid W in an arrow P direction in the UFB generating liquid flow passage 808.

FIG. 9C is a diagram illustrating a step where heat bubbling of the liquid W is generated by the heating element 10 provided on a heater board 811 constituting a part of the UFB generating liquid flow passage 808. With the heating element 10 in which a surface temperature is 300° C. or higher, film boiling 804 is generated near the heating element 10 in the liquid W, and a dissolution and saturation limit area 812 that is an area at a high temperature close to boiling is formed around the air bubble of the film boiling 804. In this dissolution and saturation limit area 812, since the temperature is high, the saturation and dissolution limit is reduced, and the gas dissolved in the gas-dissolved water 810 exceeds the dissolution limit and is precipitated as the T-UFBs 11.

FIG. 9D is a diagram illustrating a step where the air bubble of the film boiling 804 grows, and the liquid W in the UFB generating liquid flow passage 808 is moved. As the air bubble of the film boiling 804 grows, the fast main flow of the liquid W in the UFB generating liquid flow passage 808 advances in the arrow P direction. In the UFB generating liquid flow passage 808, the area of the flow passage in a plane crossing the liquid moving direction is reduced gradually and narrowed by a narrow portion 814 of the liquid flow rate amplifying element 805. Thus, the liquid W is pressurized in a high pressure area 813, and the flow rate of the high pressure liquid W passing through the narrow portion 814 is high such as 1 m/second or higher.

FIG. 9E is a diagram illustrating a step where the air bubble of the film boiling 804 grows further, and the liquid W in the UFB generating liquid flow passage 808 is moved. While the flow rate of the liquid W passing through the narrow portion 814 is high such as 1 m/second or higher, the depressurizing area 806 provided downstream of the narrow portion 814 to be adjacent to the narrow portion 814 has the area of the flow passage enlarged and larger than the area of the flow passage before passing through the narrow portion 814. Thus, the liquid W around the narrow portion 814 is depressurized by the Venturi effect. This depressurizing causes vacuum bubbles 815, insides of which are in a vacuum, to be generated while exceeding the viscous coupling of the liquid W and being teared apart. As the vacuum bubbles 815 are generated, the gas G dissolved in the liquid W near the vacuum bubbles 815 also exceeds the dissolution and saturation limit and is precipitated due to the depressurizing, and becomes the Venturi bubbles. Bubbles of smaller than 1 μm are contained in the Venturi bubbles, and they become the V-UFBs 807.

As described above, there are also bubbles larger than 1 micrometer in the Venturi bubbles generated by the above-described method. However, in a case where the Venturi bubbles are generated by generating a pressure by the operation of the film boiling, the time required for the generation and the disappearance of the vacuum bubbles 815 corresponds to the film boiling 804, and thus the time is short such as 100 microseconds or less. Thus, in a case where the vacuum bubbles 815 are generated in short time, the ratio of the V-UFBs smaller than 1 micrometer is higher and the generation efficiency of the V-UFBs is higher than that of the Venturi bubbles generated by the normal steady flow Venturi.

FIG. 9F is a diagram illustrating a step where the air bubble of the film boiling 804 grows to the maximum, and the liquid W in the UFB generating liquid flow passage 808 is moved. While the air bubble of the film boiling 804 grows to the maximum, the pressure of the liquid W becomes the highest in the high pressure area 813. Accordingly, the flow rate of the high pressure liquid W passing through the narrow portion 814 becomes the highest speed. The Venturi bubbles generated near the vacuum bubbles 815 contain many V-UFBs 807, and these many V-UFBs 807 are mixed with the T-UFBs 11 generated by the film boiling 804 in the depressurizing area 806.

FIG. 9G is a diagram illustrating a step where the air bubble of the film boiling 804 are shrunk. After the air bubble of the film boiling 804 grows to the maximum, the air bubble starts shrinking. As the air bubble shrinks, the high pressure liquid W in the high pressure area 813 is depressurized. Although a reverse flow from the depressurizing area 806 is generated in the narrow portion 814 due to the depressurizing in the high pressure area 813, it is not a flow as great as affecting the flow of the liquid W in the UFB generating liquid flow passage 808.

In the state of FIG. 9G, no V-UFBs 807 are generated. However, the precipitation of the gas G dissolved in the liquid W caused with the gas G exceeding the dissolution and saturation limit due to the depressurizing in the vicinity of the air bubble of the film boiling 804 during the disappearance process of the air bubble of the film boiling 804, and the precipitation caused by acoustic waves of the cavitation generated during the disappearance of the air bubble of the film boiling 804 cause the generation of the T-UFBs 11.

As described above, the generation processes of the T-UFBs 11 and the V-UFBs 807 are different from each other. The generation process of the T-UFBs 11 includes thermal histories, while the generation process of the V-UFBs 807 includes histories with relatively few thermal histories. In a case where the thermal histories are few like the V-UFBs, the thermal effect on the gas components contained in the V-UFBs 807 is small. Therefore, in the case of the V-UFBs 807, it is possible to generate the UFBs without transforming the properties of even the gas components that are likely to be affected by heat.

In this embodiment, with the film boiling generated by the heating element to vary the inner volume of the flow passage in the UFB generating liquid flow passage, the liquid W is pressurized such that the liquid passes through the narrow portion at high speed, and thus the UFBs are generated. However, the configuration is not limited thereto, and in order to pressurize the liquid, a flow passage inner volume varying element that varies the inner volume of the flow passage in the UFB generating liquid flow passage may be used.

Additionally, in this embodiment, the gas-dissolved water is generated by supplying the gas to the UFB generating liquid flow passage. However, the configuration is not limited thereto, and gas-dissolved water may be supplied to the UFB generating liquid flow passage.

As described above, the flow passage inner volume varying element is used to vary the flow passage inner volume, and the liquid is pressurized such that the liquid passes through the narrow portion at high speed and flows into the depressurizing area. Therefore, it is possible to provide an ultrafine bubble generating method and an ultrafine bubble generating apparatus capable of efficiently generating a UFB-containing liquid with high purity.

Second Embodiment

Hereinafter, a second embodiment of the present invention is described with reference to the drawings. Since the basic configuration of this embodiment is similar to that of the first embodiment, only a characteristic configuration is described below.

Figure 10:
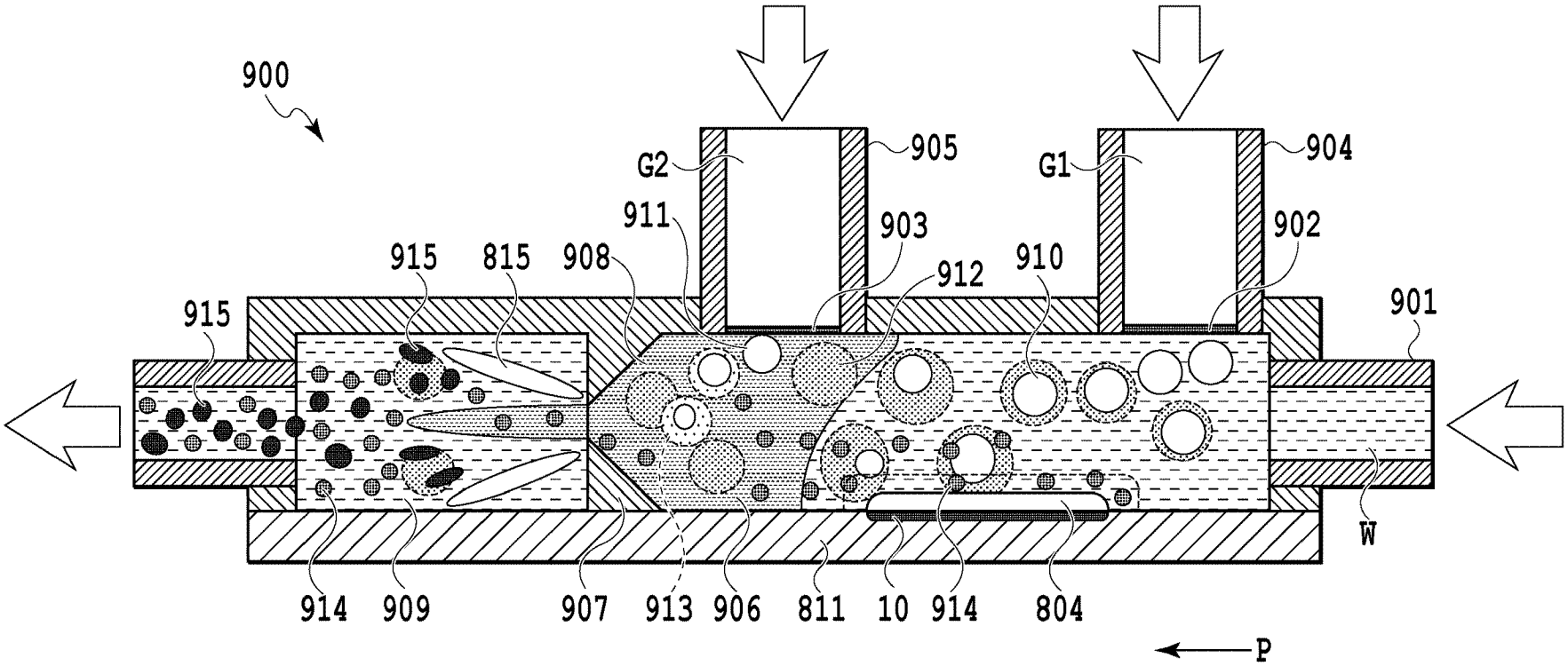
FIG. 10 is a schematic diagram illustrating a UFB generating device generating two types of UFBs.

FIG. 10 is a schematic diagram illustrating a UFB generating device 900 that generates two types of UFBs, which are UFBs containing first gas components and UFBs containing second gas components. In this embodiment, the UFBs are generated by supplying a first gas G1 and a second gas G2 to a UFB generating liquid flow passage 906. The UFB generating liquid flow passage 906 is connected with a first gas supply passage 904, which is a gas supply passage supplying the first gas G1, and a second gas supply passage 905, which supplies the second gas G2. The first gas supply passage 904 supplies the first gas G1 to the UFB generating liquid flow passage 906 through a first gas-liquid separation film 902, and the second gas supply passage 905 supplies the second gas G2 to the UFB generating liquid flow passage 906 through a second gas-liquid separation film 903.

With the first gas G1 being supplied to the UFB generating liquid flow passage 906, becoming first gas bubbles 910, and being dissolved into the liquid W, the first gas G1 becomes first gas-dissolved water 912. With the second gas G2 being supplied to the UFB generating liquid flow passage 906, becoming second gas bubbles 911, and being dissolved into the liquid W, the second gas G2 becomes the second gas-dissolved water 913. There is also mixed dissolved water of the first gas G1 and the second gas G2 in a high pressure area 908.

Although the second gas supply passage 905 is provided near the first gas supply passage 904 and the heating element 10 in FIG. 10 for the sake of clarity, the second gas supply passage 905 is actually provided sufficiently away from the first gas supply passage 904 and the heating element 10. The liquid W is continuously supplied from a liquid supply passage 901, and a gentle flow in the arrow P direction is generated in the UFB generating liquid flow passage 906.

Thus, the second gas-dissolved water 913 and the mixed dissolved water of the first gas G1 and the second gas G2 are not heated by the heating element 10, and the gas components contained in T-UFBs 914 are the first gas G1 while no components of the second gas G2 are contained in the T-UFBs 914.

In the high pressure area 908, there are the first gas-dissolved water 912, the second gas-dissolved water 913, and the mixed dissolved water of the first gas G1 and the second gas G2. Thus, the gas components contained in V-UFBs 915 are the first gas G1 components, the second gas G2 components, and mixed components of the first gas G1 and the second gas G2, and three types of V-UFBs 915 are generated.

That is, the UFB generating device 900 generates four types of UFBs, which are the T-UFBs 914 containing the first gas components, the V-UFBs 915 containing the first gas components, the V-UFBs 915 containing the second gas components, and the V-UFBs 915 containing the mixed components of the first gas G1 and the second gas G2.

Figure 11:
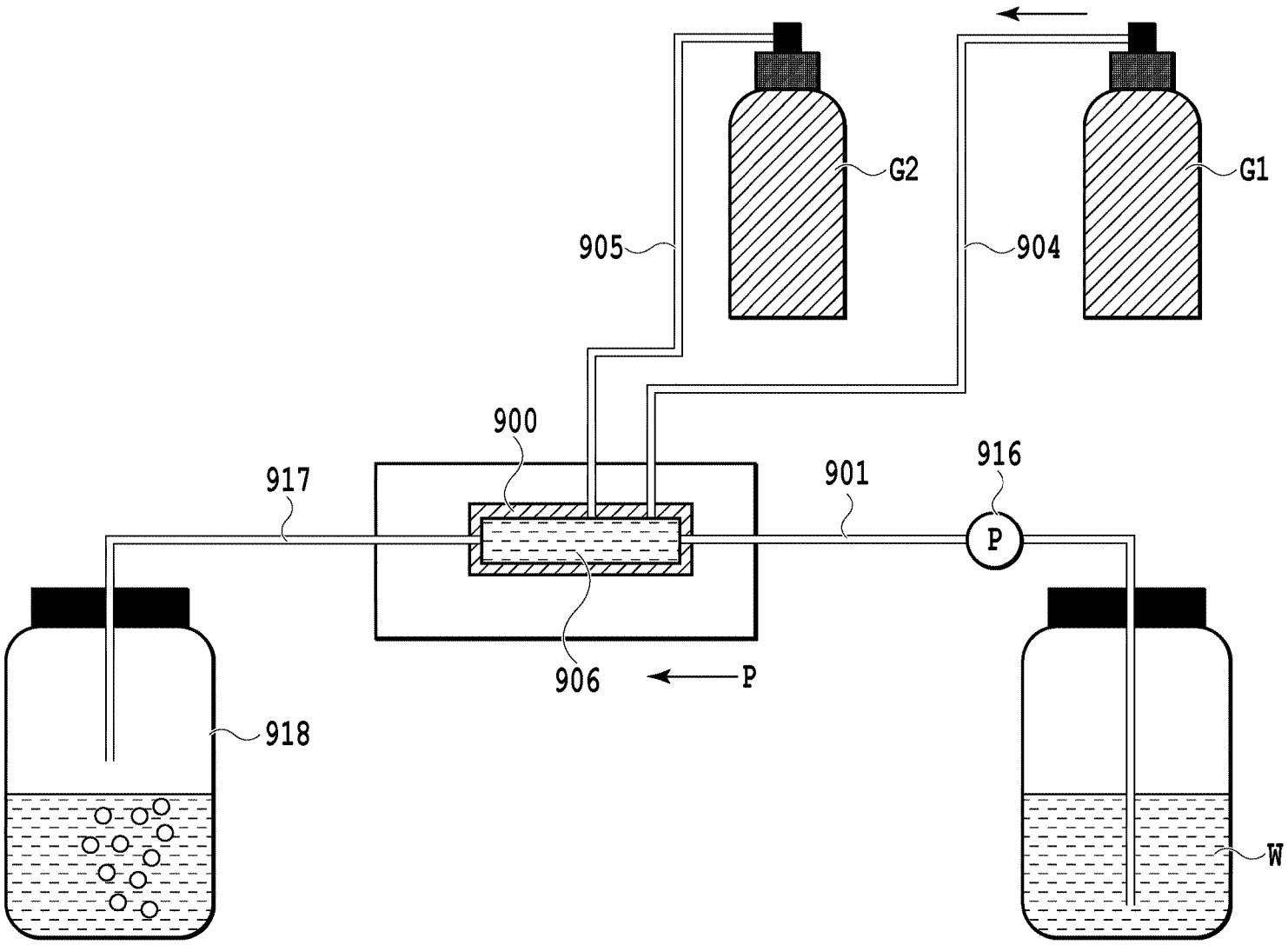
FIG. 11 is a diagram illustrating supply passages that supply two types of gases and a liquid to a UFB generating liquid flow passage.

FIG. 11 is a diagram illustrating a configuration of supply passages for supplying the two types of gases that are the first gas G1 and the second gas G2 and the liquid W to the UFB generating liquid flow passage 906 of the UFB generating device 900. The first gas G1 is supplied to the UFB generating device 900 through the first gas supply passage 904, and the second gas G2 is supplied to the UFB generating device 900 through the second gas supply passage 905. The liquid W is supplied to the UFB generating device 900 by the operation of a pump 916 through the liquid supply passage 901. The liquid W flows in the arrow P direction at a speed considerably lower than the speed of the growth of the film boiling and the liquid flow rate of generating the Venturi phenomenon. This intends to make the liquid flow relatively low to prevent the liquid flow from affecting the generation of the UFBs to improve the stability of the generation of the UFBs and to increase the density of the UFBs in the liquid.

The UFBs are generated in the UFB generating device 900, and the liquid W containing the UFBs is ejected from a liquid ejection passage 917 to be stored in a UFB liquid tank 918.

Since the thermal effect on the UFBs is small in the generation of the V-UFBs as described above, in a case of using a gas likely to be affected by heat, it is preferable to use the gas as the second gas G2.

Third Embodiment

Hereinafter, a third embodiment of the present invention is described with reference to the drawings. Since the basic configuration of this embodiment is similar to that of the first embodiment, only a characteristic configuration is described below.

Figure 12:
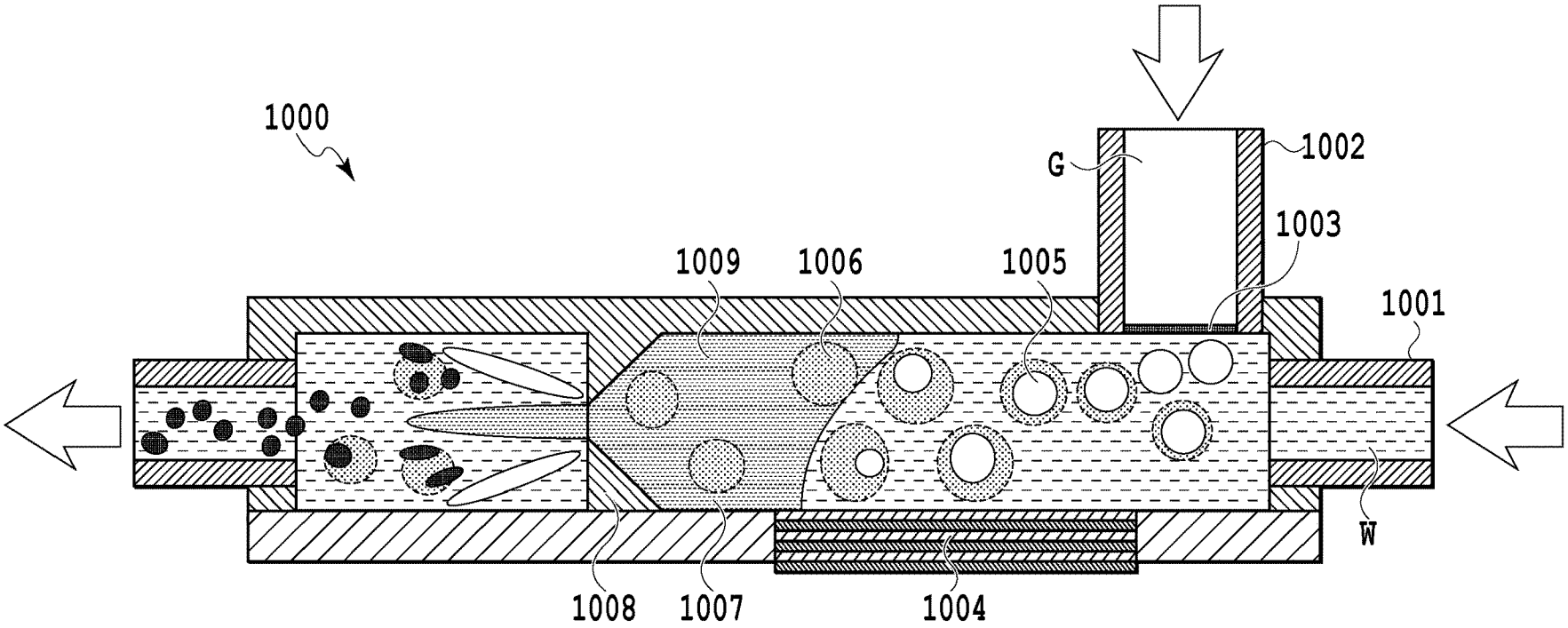
FIG. 12 is a schematic diagram illustrating a UFB generating device.

FIG. 12 is a schematic diagram illustrating a UFB generating device 1000 in this embodiment. In the above-described embodiments, the film boiling by the heating element 10 is used to increase the pressure on the liquid W in the high pressure area; however, in this embodiment, a piezo element 1004 that is a piezoelectric element is used to increase the pressure on the liquid W.

The UFB generating device 1000 includes the piezo element 1004 and is capable of changing the inner volume of a UFB generating liquid flow passage 1007 by applying a voltage to the piezo element 1004, and is capable of decreasing and increasing the inner volume by changing the polarity of the voltage. With a voltage being applied to the piezo element 1004 to decrease the inner volume of the UFB generating liquid flow passage 1007, it is possible to increase the pressure on the liquid W in a high pressure area 1009.

The piezo element 1004 is intended for changing the inner volume of the UFB generating liquid flow passage 1007, and the piezo element itself does not generate the UFBs like the heating element generating the T-UFBs.

Figure 13A:
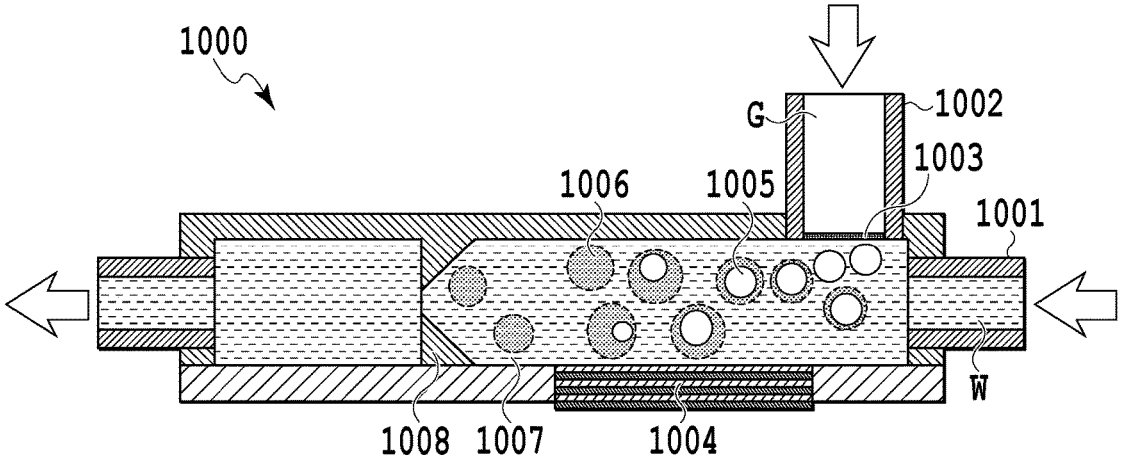
FIG. 13A is a diagram illustrating steps of generating a UFB-containing liquid by the UFB generating device in sequence.
Figure 13B:
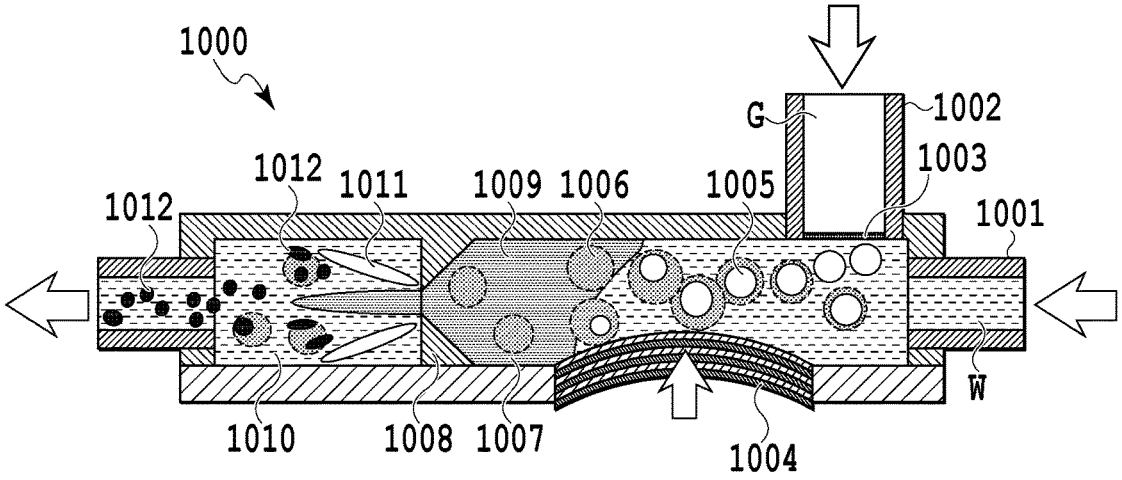
FIG. 13B is another diagram illustrating steps of generating a UFB-containing liquid by the UFB generating device in sequence.
Figure 13C:
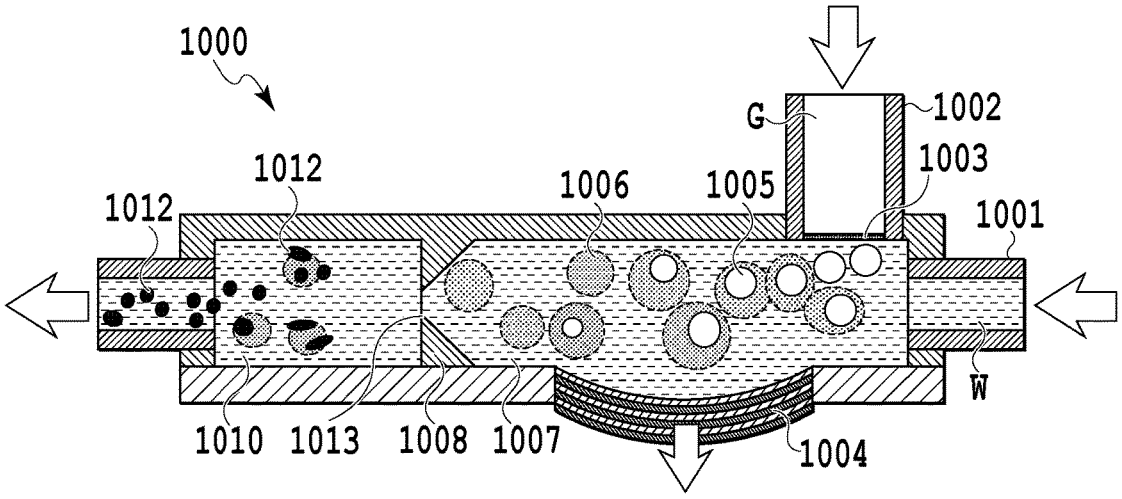
FIG. 13C is a yet another illustrating steps of generating a UFB-containing liquid by the UFB generating device in sequence.

FIGS. 13A to 13C are diagrams illustrating operation steps of generating the UFB-containing liquid W by the UFB generating device 1000 in sequence. Hereinafter, the operation steps are described in the order of the operations. FIG. 13A is a diagram illustrating a step where the liquid W is supplied from a liquid supply passage 1001 into the UFB generating liquid flow passage 1007, and the gas G is supplied from a gas supply passage 1002. The UFB generating device 1000 includes the liquid supply passage 1001 to which the liquid W is supplied, the gas supply passage 1002 to which the gas G is supplied, and the UFB generating liquid flow passage 1007 as a flow passage generating the UFBs. The gas G supplied to the supplied liquid W through a gas-liquid separation film 1003 becomes gas bubbles 1005 in the form of bubbles, and the gas G is dissolved into the liquid W to form a gas-dissolved liquid 1006.

FIG. 13B is a diagram illustrating a step where the piezo element 1004 is displaced by applying a voltage to the piezo element 1004 to reduce the inner volume in the UFB generating liquid flow passage 1007. It is possible to displace the piezo element 1004 by applying a voltage to the piezo element 1004, and it is possible to reduce the inner volume in the UFB generating liquid flow passage 1007 as illustrated in FIG. 13B. With the inner volume in the UFB generating liquid flow passage 1007 being reduced as the piezo element 1004 is displaced, the pressure on the liquid W in the pressure area 1009 is increased. With the maximum displacement of the piezo element 1004, the pressure on the liquid W in the high pressure area 1009 becomes the highest pressure, and the flow rate of the high pressure liquid W passing through a narrow portion 1013 becomes a high speed such as 1 m/second or higher.

Since the pressure near the narrow portion 1013 of a depressurizing area 1010 is reduced by the Venturi effect, vacuum bubbles 1011, insides of which are in a vacuum, are generated while exceeding the viscous coupling of the liquid W and being teared apart. As the vacuum bubbles 1011 are generated, the gas G that is dissolved in the liquid W by the depressurizing near the vacuum bubbles 1011 become the Venturi bubbles while exceeding the dissolution and saturation limit and precipitating. The Venturi bubbles contain bubbles of smaller than 1 μm, and those small bubbles become V-UFBs 1012. The Venturi bubbles also contain bubbles larger than 1 μm; however, since the time required for the generation of the vacuum bubbles 1011 is considerably short such as 1 millisecond or less, which corresponds to the time required for the displacement of the piezo element, the ratio of the V-UFBs 1012 smaller than 1 μm is higher and the generation efficiency of the V-UFBs is higher than that of the normal steady flow Venturi.

FIG. 13C is a diagram illustrating a step where a voltage of the opposite polarity from the case of FIG. 13B is applied to the piezo element 1004 to make the displacement, and the inner volume in the UFB generating liquid flow passage 1007 is increased. With the piezo element 1004 being displaced to increase the inner volume in the UFB generating liquid flow passage 1007, the entering of the liquid from a narrow portion 1013 of a liquid flow rate amplifying element 1008 to the depressurizing area 1010 at a high flow rate is stopped instantaneously. This makes it possible to inhibit the generation of the Venturi bubbles of a size larger than 1 μm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-021502 filed Feb. 12, 2020, which is hereby incorporated by reference wherein in its entirety.

What is claimed is:

1. A method of generating ultrafine bubbles, comprising:

a liquid supplying step where a liquid is supplied to a flow passage that allows the liquid to flow;

a flow passage inner volume varying step where an inner volume of the flow passage to which the liquid is supplied is varied by varying a part of the flow passage;

a pressurizing step where, due to operation of the flow passage inner volume varying step, the liquid that has an amplified flow rate and is pressurized is caused to pass through a narrow portion, which narrows a part of the flow passage such that a flow passage area that is an area of a plane crossing a direction of the flow of the liquid in the flow passage is gradually reduced from upstream to downstream of the flow passage; and a depressurizing step where the liquid that is pressurized in the pressurizing step is depressurized in a depressurizing area having a flow passage area greater than the narrow portion, wherein in the flow passage inner volume varying step, the inner volume of the flow passage is decreased due to operation of film boiling by a heating element.

2. The method of generating ultrafine bubbles according to claim 1, further comprising:

a gas supplying step where a desired gas is supplied to the liquid supplied to the flow passage, wherein ultrafine bubbles containing the desired gas are generated.

3. The method of generating ultrafine bubbles according to claim 1, wherein the liquid is depressurized by restoring a decreased inner volume of the flow passage by shrinkage of a film boiling bubble generated by heating of the heating element.

4. The method of generating ultrafine bubbles according to claim 2, wherein in the gas supplying step, a plurality of types of gases are supplied.

5. A method of generating ultrafine bubbles, comprising:

a liquid supplying step where a liquid is supplied to a flow passage that allows the liquid to flow;

a flow passage inner volume varying step where an inner volume of the flow passage to which the liquid is supplied is varied by varying a part of the flow passage;

a pressurizing step where, due to operation of the flow passage inner volume varying step, the liquid that has an amplified flow rate and is pressurized is caused to pass through a narrow portion, which narrows a part of the flow passage such that a flow passage area that is an area of a plane crossing a direction of the flow of the liquid in the flow passage is gradually reduced from upstream to downstream of the flow passage;

a depressurizing step where the liquid that is pressurized in the pressurizing step is depressurized; and a gas supplying step where a first gas and a second gas that is thermally affected more than the first gas are supplied to the liquid supplied to the flow passage, wherein in the flow passage inner volume varying step, the inner volume of the flow passage is decreased due to the operation of film boiling generated by heating of a heating element in a first dissolved liquid in which the first gas is dissolved but no second gas is dissolved, and wherein in the gas supplying step, ultrafine bubbles are generated by supplying the first gas and the second gas.

6. An ultrafine bubble generating apparatus, comprising:

a liquid supplying unit that supplies a liquid to a flow passage that allows the liquid to flow;

a flow passage inner volume varying unit that varies an inner volume of the flow passage to which the liquid is supplied by varying a part of the flow passage;

a liquid flow rate amplifying unit that narrows a part of the flow passage into a narrow portion such that a flow passage area that is an area of a plane crossing a direction of the flow of the liquid in the flow passage is gradually reduced from upstream to downstream of the flow passage; and a depressurizing unit that depressurizes the liquid that passes through the liquid flow rate amplifying unit in a depressurizing area having a flow passage area greater than the narrow portion, wherein the inner volume of the flow passage is decreased due to operation of film boiling by a heating element, and wherein the liquid, which has an amplified flow rate and is pressurized due to operations of the flow passage inner volume varying unit and the liquid flow rate amplifying unit, is caused to pass through the liquid flow rate amplifying unit, and thus ultrafine bubbles are generated.

* * * * *